United States Patent [19]

Stumpf

[11] 3,941,367

[45] Mar. 2, 1976

[54] FABRIC LAYERING MACHINE

[76] Inventor: Gunter Stumpf, Hohenweg 13, 7421 Mehrstetten (Kr. Munsingen), Germany

[22] Filed: Mar. 28, 1974

[21] Appl. No.: 455,734

[30] Foreign Application Priority Data

Mar. 30, 1973 Germany ..... 7312182[U]

[52] U.S. Cl. ..... 270/31

[51] Int. Cl.[2] ..... B65H 29/46

[58] Field of Search ..... 270/30–31

[56] References Cited

UNITED STATES PATENTS

| | | | |
|---|---|---|---|
| 2,442,352 | 6/1948 | Gilbert | 270/31 |
| 3,506,254 | 4/1970 | Stumpf | 270/31 |

FOREIGN PATENTS OR APPLICATIONS

| | | | |
|---|---|---|---|
| 794,463 | 5/1958 | United Kingdom | 270/31 |
| 40,874 | 9/1965 | Germany | 270/31 |

*Primary Examiner*—Clyde I. Coughenour
*Assistant Examiner*—A. Heinz
*Attorney, Agent, or Firm*—Haseltine, Lake & Waters

[57] ABSTRACT

A fabric layering machine for movement along a layering table, comprising a frame, mounting means carried by said frame for mounting a supply of fabric, a pair of draw-off rollers arranged to provide a nip therebetween and readily removable from an operative position on said frame, and power means operable to rotate said draw-off rollers in opposite senses to each other for pulling through said nip a web of fabric extending from said supply of fabric.

12 Claims, 7 Drawing Figures

FABRIC LAYERING MACHINE

This invention relates to a fabric layering machine for movement along a layering table.

German Gebrauchsmuster No. 1,977,821 discloses a fabric layering machine for layering single-layer fabric. This machine can be fitted with a layering head, for layering in zig-zag configuration, or a web-severing device, the two being readily interchangeable.

There is also known a fabric layering machine suitable exclusively for layering tubular fabric, such as circular-knitting fabric, and which has for this purpose a pair of calender-like draw-off rollers.

Heretobefore, to undertake layering of webs of single-layer fabric and webs of tubular fabric, it has been necessary to have available two layering machines, such as for example those just mentioned.

By means of the invention it is possible to carry out the layering of single-layer fabric and tubular fabric with one and the same fabric layering machine.

The present invention provides a fabric layering machine for movement along a layering table, comprising a frame, mounting means carried by said frame for mounting a supply of fabric, a pair of draw-off rollers arranged to provide a nip therebetween and readily removable from an operative position on said frame, and power means operable to rotate said draw-off rollers in opposite senses to each other for pulling through said nip a web of fabric extending from said supply of fabric.

In order that the invention may be clearly understood and readily carried into effect, reference will now be made, by way of example, to the accompanying drawings, in which.

Figure 1:
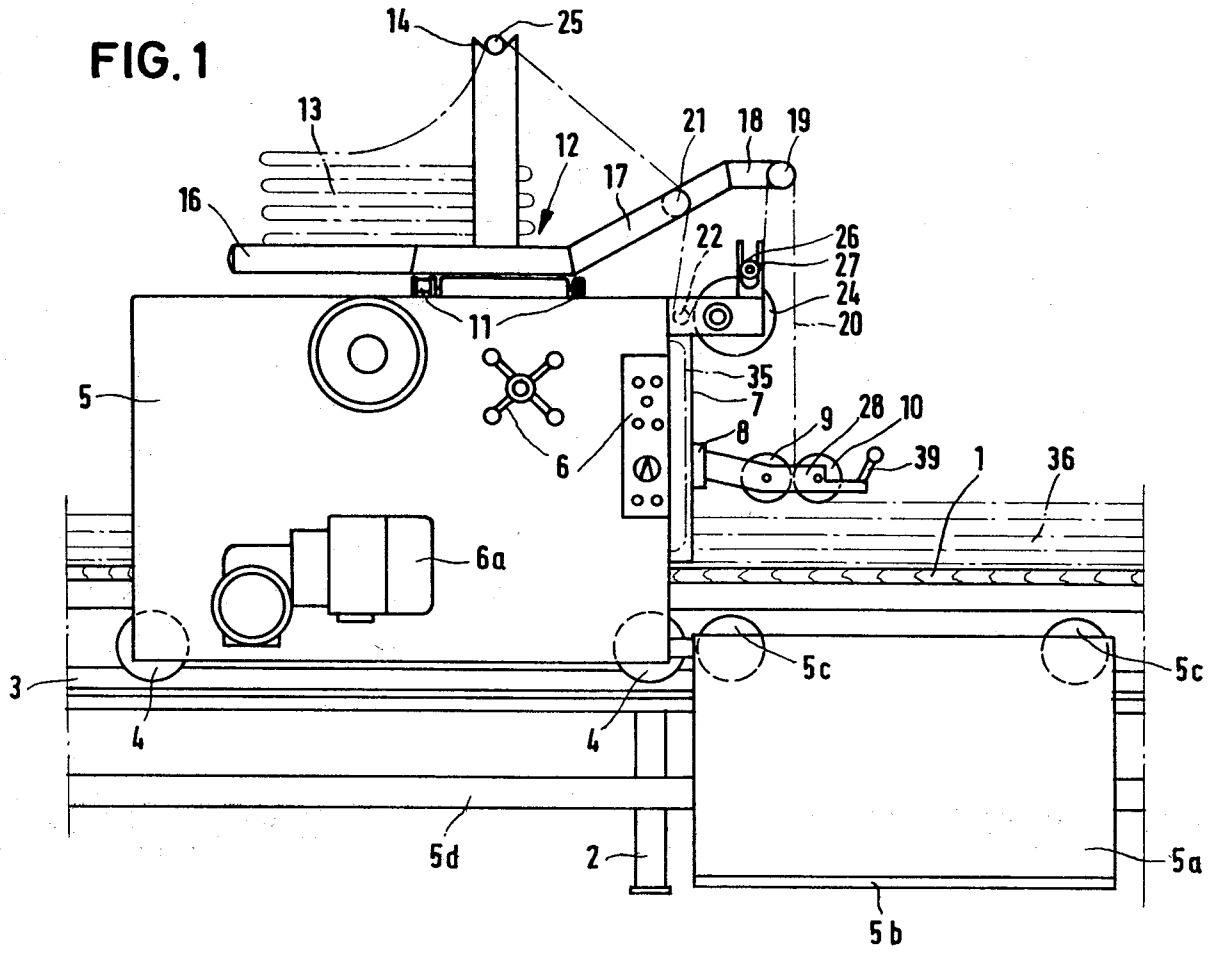
FIG. 1 shows a side elevation of a fabric layering machine and parts of a layering table.

Referring to FIG. 1, a layering table has a table top 1 supported by legs 2 (only one of which is shown). Secured to the legs 2, on each longitudinal side of the layering table, are travel rails 3 on which a fabric layering machine is arranged to run by way of wheels 4 secured to a frame 5 of the machine. On the frame 5 there is provided an operating console 6. A drive motor for driving the layering machine along the layering table is designated 6*a*. Releasably coupled to the frame 5 is a follower carriage 5*a* having an operating platform 5*b*. The carriage 5*a* is provided with wheels 5*c* which run on the rails 3. The follower carriage 5*a* is also supported by at least one support wheel (not shown) having a vertical axis and running on a flat rail 5*d* of the layering table.

At the right-hand end of the frame 5 (as viewing FIG. 1) there are secured two guide rails 7 extending vertically downwardly approximately as far as the table top 1 and serving, via a carrier element 8, for guiding a draw-off head 28 having a pair of draw-off rollers 9, 10. The draw-off head is releasably attached to the carrier element 8 by means described further below.

Figure 4:
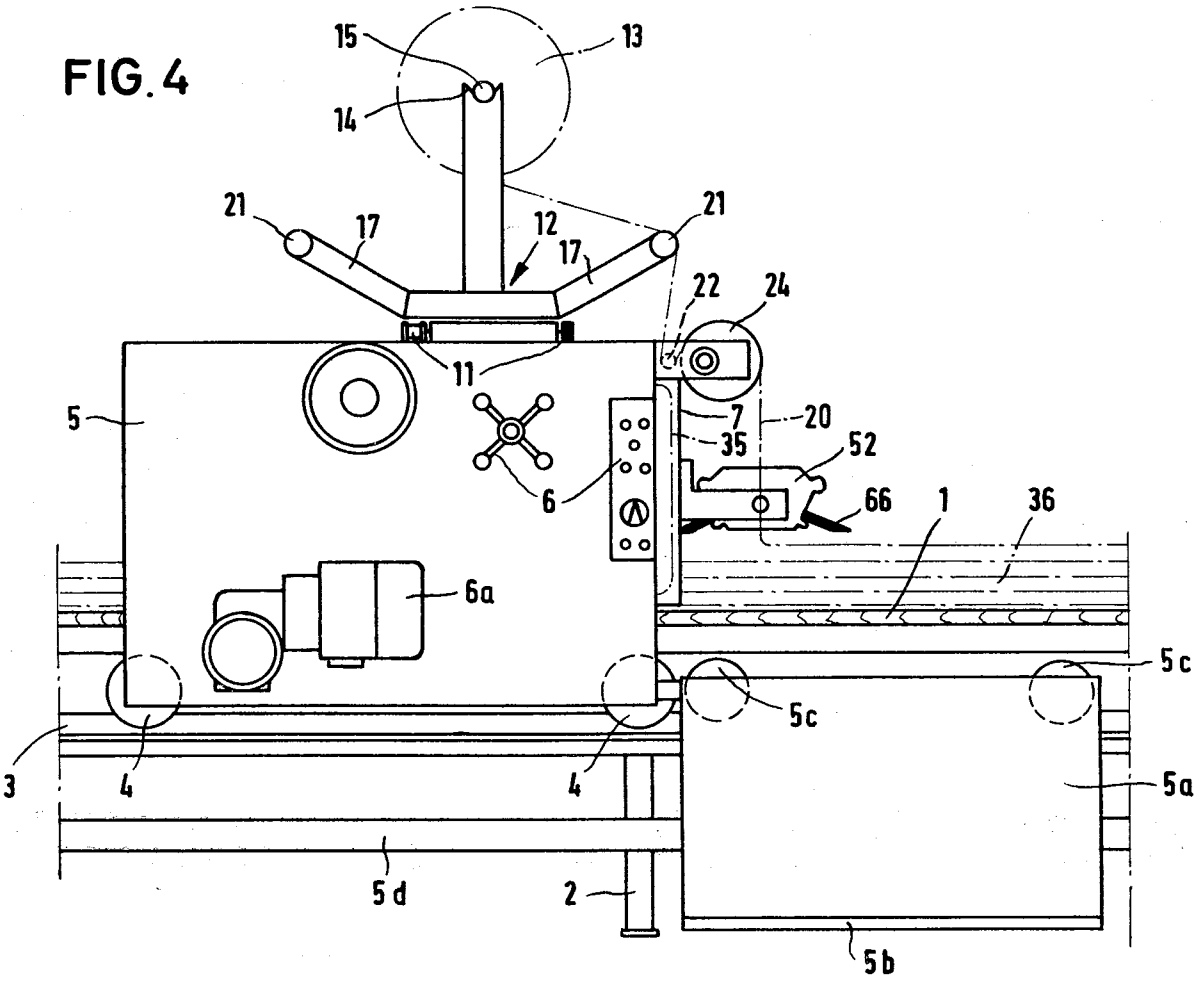
FIG. 4 shows a view similar to that of FIG. 1 but with the draw-off head having been replaced by a layering head.
Figure 5:
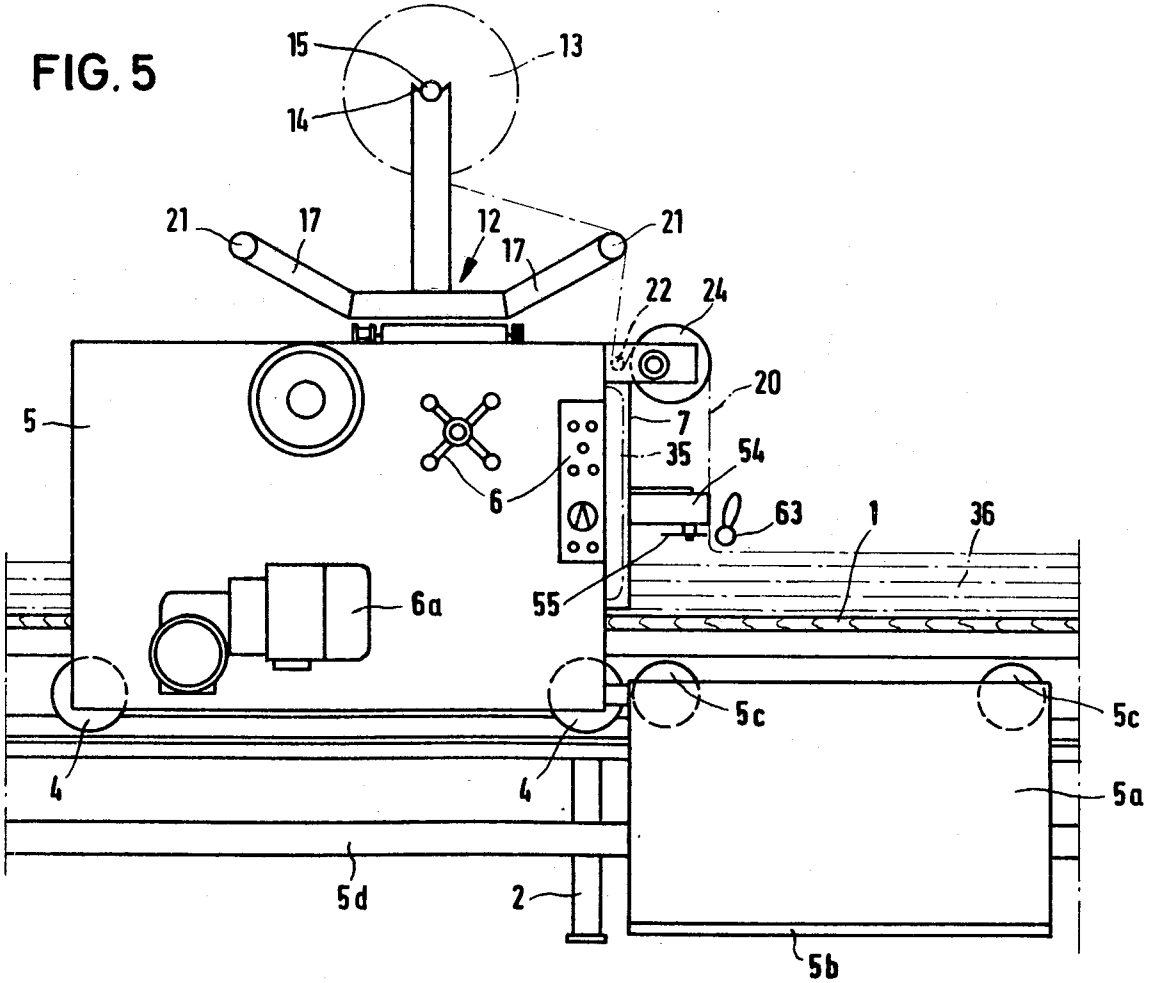
FIG. 5 shows a view similar to that of FIG. 1 but with the draw-off head having been replaced by a web-severing device.

Disposed at an upper part of the frame 5 is a mounting carriage 12, displaceable, by way of wheels 11, transversely of the travel direction of the layering machine and carrying mounting means for a fabric supply 13 to be laid-up. The mounting means is provided by both a releasable platform 16 (as shown in FIG. 1) for supporting a flat-folded, i.e. zig-zag, bale of tubular fabric forming the fabric supply 13, and bearing members 14 for receiving the ends of a pivot shaft 15 of a roll of single-layer fabric forming the fabric supply 13 (as shown in FIGS. 4 and 5). The platform 16 is in the form of a grid.

The mounting carriage 12 also has upwardly inclined cantilever arms 17 which (as is shown in FIGS. 4 and 5) can be arranged at both sides of the carriage 12 or (as is shown in FIG. 1) at one side only. In the latter case, the left-hand arms 17 are replaced by the platform 16.

Referring to FIG. 1, there is mounted by the arms 17, via spacer members 18, a guide roller 19 guiding a web 20 of tubular fabric to be laid-up, so as to ensure that the web 20 approaches the nip between the rollers 9, 10 vertically.

For the purpose of laying-up, the web 20 passes over a lead roller 21, mounted on the arms 17 at the right-hand side of the carriage 12, under a deflection roller 22 mounted on the frame 5, and then over a power-driven feed roller 24 also mounted on the frame 5. In the arrangement shown in FIG. 1, there is disposed upstream of the lead roller 21 an intermediate roller 25 mounted in the bearing member 14 and serving for imparting uniformity to the draw-off of the flat-folded fabric supply 13 on the platform 16. Also provided in the arrangement shown in FIG. 1 is a pressing-on roller 26 which presses the web 20 onto the feed roller 24 and is disposed upstream of the guide roller 19. The pressing-on roller 26 is mounted releasably in forks 27, providing a holding means, carried by the frame 5, so that the roller 26 is adjustable as to spacing relative to the feed roller 24. The rollers 22 and 26 serve for achieving a contact arc between the web 20 and the feed roller 24 (corresponding approximately to an arc length of $\pi/2$), in order that effective fabric feed may be made possible not only by the draw-off rollers 9, 10 but also by the feed roller 24.

By suitably selecting the speed of rotation of the feed roller 24 relative to the draw-off rollers 9, 10, fabric can be laid-up free from tension and distortion.

Figures 2, 3:
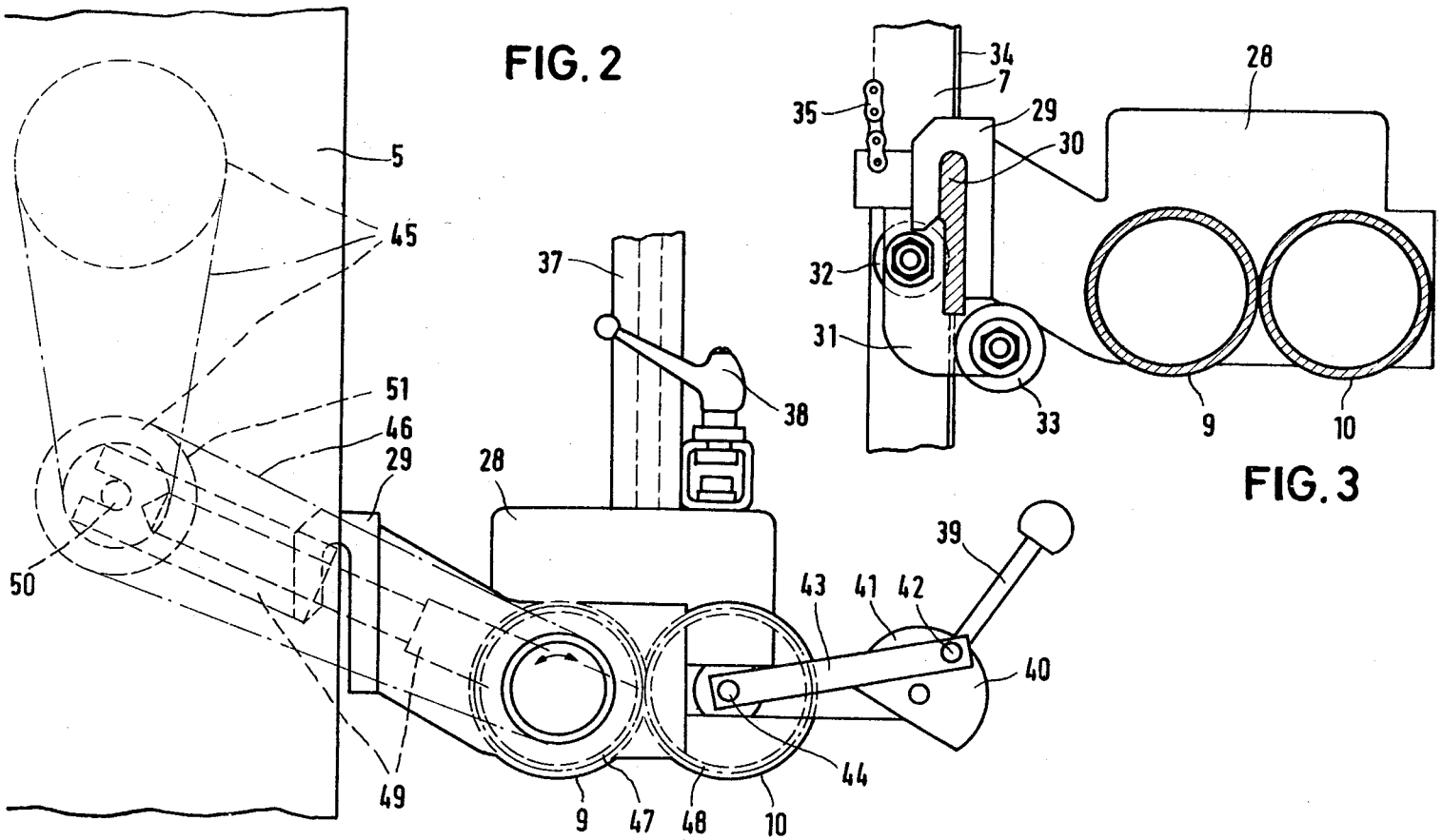
FIG. 2 shows, to an enlarged scale, a side elevation of a draw-off head of the fabric layering machine.
FIG. 3 shows a sectional view corresponding to FIG. 2.

Referring to FIGS. 1 to 3, in order to make possible the attachment and removal of the layering head 28, and in such manner that no special securing means, such as retaining screws or the like, require to be actuated, the layering head 28 is provided with an inverted-U hook element 29 engaging from above over a flat attachment bar 30. The attachment bar 30 is secured to a slide 31 which runs on the rails 7 by way of pairs of wheels 32, 33 bearing at opposite sides on a flange 34 of each guide rail 7. The layering head 28 is vertically adjustable by chains 35, secured to the slides 31, as a function of the height of the uppermost web length of the web lengths 36 disposed on the table top 1. The spacing of the two guide rails 7 is so selected that reliable guiding of the attachment bar 30 is achieved. Expediently, this spacing is somewhat smaller than the width of the frame 5. A locking screw (not shown), or the like, for locking the hook element 29 to the bar 30 may be utilised without noticeably lengthening the short time required for attachment and removal of the layering head 28.

Secured at an upper part of the layering head 28 are two vertically extending retaining rails 37 for a temple (not shown) over which the tubular web 20 is pulled-out in order to achieve constant fabric width and precise superpositioning of the edges of the web lengths 36. The retaining rails 37 are associated with a clamping device 38 with the aid of which the retaining rails 37 can, after adjustment to the tubular fabric width (and consequently the temple width) required, be locked in position.

Mounted on the layering head 28 is also an eccentric lever 39 connected with an eccentric disc 41 pivotal about a fixed bearing axis 40. Articulated to the eccentric disc 41, at 42, is a connecting rod 43 also articulated at the pivot axis 44 of the right-hand draw-off roller 10 (see FIG. 2). On pivoting the eccentric lever 39 clockwise, the draw-off roller 10 is displaced towards the right, i.e. away from the draw-off roller 9, so that before the commencement of layering the fabric web 20 can be passed between the draw-off rollers 9, 10. As soon as the web 20 has been passed between the draw-off rollers, the eccentric lever 39 is pivoted counter-clockwise, so that both draw-off rollers 9, 10 are in frictional engagement with the web 20.

The left-hand draw-off roller 9 is driven by a drive 45 provided on the frame 5, via a releasable drive belt 46, for example a toothed belt, providing a transmission means. Drive is transmitted from the draw-off roller 9 to the draw-off roller 10 by way of the engagement of gears 47, 48.

The belt 46 is associated with a tensioning device 49 mounted on the layering head 28 and bearing on the frame 5 at a pivot 50 of a pulley 51 of the drive 45.

Figure 7:
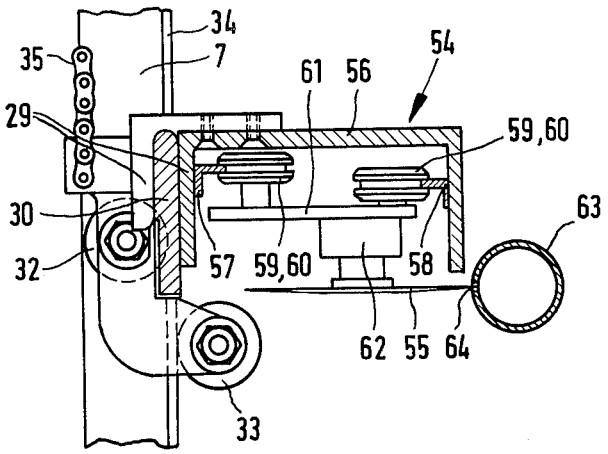
FIG. 7 shows, to an enlarged scale, a sectional elevation of the web-severing head of FIG. 5.
Figure 6:
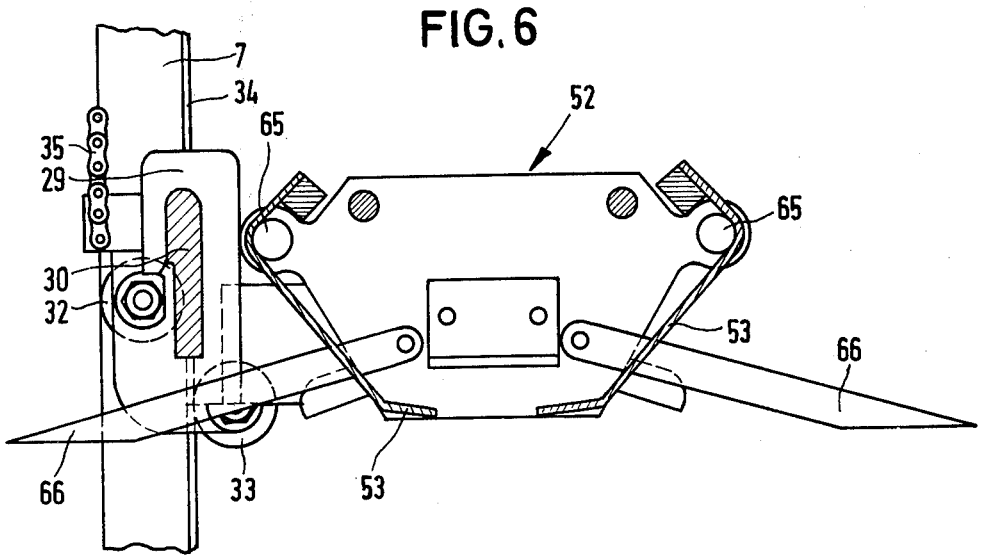
FIG. 6 shows, to an enlarged scale, a sectional elevation of the layering head of FIG. 4.

After the layering head 28 has been disengaged from the attachment bar 30, the belt 46 has been removed, and the pressing-on roller 26 has been removed, the fabric layering machine, hitherto employed for the laying-up of tubular fabric, can be utilised for the laying-up of single-layer fabric. For this purpose there is attached to the bar 30 either a layering head 52, having plaiting shovels 53 (see FIG. 6), or a web-severing device 54 (see FIG. 7), each of which is fitted with a hook element 29 the same as that of the layering head 28. The web 20 then travels (see FIGS. 4 and 5) directly from the feed roller 24 between the plaiting shovels 53 or into the cutting zone of a power-driven circular knife 55 of the web-severing device 54.

The web-severing device 54 has an inverted U-section rail 56 the length of which corresponds substantially to the width of the frame 5. Secured to each of the inner faces of the limbs of the U-section rail 56 is a small angle-rail 57, 58 each serving for guiding two travel rollers, only one travel roller being visible in respect of each rail 57, 58. Secured to the travel roller 57, 58 is a plate 61 on the underside of which there is provided a drive 62 for driving rapidly the circular knife 55. In the cutting zone of the circular knife 55 there is a cylindrical member 63 extending parallel to the U-section rail 56 and having a longitudinally extending cutting slot 64 constituting a counter-blade guideway.

The plaiting shovels 53 of the layering head 52 are mounted to be pivotal about horizontal pivots 65. Running-up cams 66 produce the effect that in each particular instance one of the two plaiting shovels 53 pushes the folded-back web engaging about its front edge under one of two clamping devices (not shown) provided at the two ends of the table top 1.

What I claim is:

1. A fabric layering machine for movement along a layering table, comprising a frame, mounting means carried by said frame for mounting a supply of a web of fabric, a pair of rotatable draw-off rollers positioned in proximity to each other so as to form a fabric-engaging nip therebetween and being detachably mounted in an operative position on said frame, guide roller means detachably fastened on said frame above said draw-off rollers for guiding said fabric web into the nip between said draw-off rollers, and power means operable to rotate said draw-off rollers in opposite senses to each other for pulling through said nip said web of fabric extending from said supply of fabric, a feed roller carried by said frame and disposed to feed said web towards the nip between said drawoff rollers, further power means operable to rotate said feed roller for feedinng forward said web, a deflection roller carried by said frame and disposed proximate the surface of said feed roller for causing said web to contact said feed roller over an arc of contact, a pressing roller carried by said frame for cooperating with said deflection roller when said web extends around said feed roller so as to cause said web to contact said feed roller, and adjustable holding means for holding the pressing roller for adjusting the position of said pressing roller relative to said feed roller, said detachably mounted guide roller means and draw-off rollers adapted to be selectively removed and replaced by other operative components for converting said machine from single-layer fabric to tubular fabric operation, and reversely.

2. A fabric layering machine as claimed in claim 1, in which said draw-off rollers are mounted in a draw-off head carried by said frame, said head being detachably mounted on said frame.

3. A fabric layering machine as claimed in claim 2, in which said draw-off head includes adjustment means for adjusting the position of said draw-off rollers relative to each other.

4. A fabric layering machine as claimed in claim 2, in which said frame includes attachment-bar means extending transversely of the direction of movement of the machine along said table, and said draw-off head detachably mounted on said frame by hook means engaging over said attachment-bar means.

5. A fabric layering machine as claimed in claim 1, comprising movable slide means connected to said attachment bar means for supporting said draw-off rollers so as to be carried by said frame to be raisable and lowerable relative to said table.

6. A fabric layering machine as claimed in claim 1, in which said power means includes transmission means detachably connected to one of said draw-off rollers for transmission of drive thereto, and the other of said draw-off rollers is drivably coupled to said one of said draw-off rollers.

7. A fabric layering machine as claimed in claim 1, in which said guide roller means is carried by said mounting means.

8. A fabric layering machine as claimed in claim 1, in which said mounting means includes platform means for supporting a flat-folded bale of fabric forming said supply of fabric.

9. A fabric layering machine as claimed in claim 1, in which said mounting means includes support means for supporting a roll of fabric forming said supply of fabric.

10. A fabric layering machine as claimed in claim 1, in which said mounting means includes positioning means operable to move said mounting means relative to said frame transversely of the direction of movement of the machine along the table.

11. A fabric layering machine as claimed in claim 1, including a web-severing device adapted to be detachably fastened to said frame in place of said draw-off rollers.

12. A fabric layering machine as claimed in claim 1, comprising a layering head adapted to be detachably fastened to said frame in place of said draw-off rollers.

* * * * *